US005697541A

United States Patent [19]

Burke et al.

[11] Patent Number: 5,697,541

[45] Date of Patent: Dec. 16, 1997

[54] CANISTER-TYPE MAGAZINE FOR A FASTENER DRIVING TOOL

[75] Inventors: John T. Burke, Williamsburg; John P. Crutcher; Daniel A. Oliver, both of Cincinnati, all of Ohio

[73] Assignee: Senco Products, Inc., Cincinnati, Ohio

[21] Appl. No.: 367,431

[22] Filed: Dec. 30, 1994

[51] Int. Cl.[6] ..... B25C 1/04; B25C 1/00

[52] U.S. Cl. ..... 227/109; 227/120; 227/128; 227/136

[58] Field of Search ..... 227/109, 120, 227/135, 136, 137

[56] References Cited

U.S. PATENT DOCUMENTS

| | | | |
|---|---|---|---|
| 3,330,462 | 7/1967 | Colechia et al. | 227/136 |
| 3,543,987 | 12/1970 | Obergfell et al. | 227/136 |
| 3,703,981 | 11/1972 | Smith | 227/136 |
| 3,708,097 | 1/1973 | Fisher | 227/136 |
| 4,585,154 | 4/1986 | Fealey et al. | 227/136 X |
| 4,619,393 | 10/1986 | Maurer | 227/136 |
| 4,669,648 | 6/1987 | Monacelli | 227/136 X |
| 4,729,164 | 3/1988 | Steeves | 29/809 |
| 5,240,161 | 8/1993 | Kaneko | 227/136 X |
| 5,267,682 | 12/1993 | Okouchi | 227/151 |

FOREIGN PATENT DOCUMENTS

| | | | |
|---|---|---|---|
| 386950 | 9/1990 | European Pat. Off. . | |
| 3403312 | 8/1984 | Germany . | |
| 2149754 | 6/1985 | United Kingdom | 227/136 |

*Primary Examiner*—Jack W. Lavinder
*Assistant Examiner*—Jay A. Stelacone
*Attorney, Agent, or Firm*—Jerrold J. Litzinger

[57] ABSTRACT

A canister-type magazine for the class of fastener driving tool which uses a coil of tandemly arranged fasteners. The magazine comprises a substantially cylindrical body having a top, a bottom and a side wall, and is made up of a fixed body part and a movable body part. The fixed body part has a forward end attached to the tool fastener feed mechanism and a rearward end attached to the tool handle. The fixed body part comprises the top and a segment of the side wall of the magazine. The movable body part has forward and rearward ends and comprises the bottom, the fastener coil support surface, and the remainder of the side wall of the magazine. The movable body part is pivotally affixed at its rearward end to a hinge member. The hinge member, in turn, is adjustably mounted in a hinge member support constituting a portion of the rearward end of the fixed body part. The hinge member is axially shiftable with respect to the hinge member support enabling adjustment of the distance between the canister top and bottom for accommodation of fasteners of different lengths. The movable body part is swingable about its pivotal connection to the hinge member between a closed position and an open position to which it is spring biased and in which the fastener coil support surface is fully accessible.

10 Claims, 17 Drawing Sheets

CANISTER-TYPE MAGAZINE FOR A FASTENER DRIVING TOOL

TECHNICAL FIELD

The invention relates to an improved canister-type magazine for a fastener driving tool adapted to use a coil of fasteners, and more particularly to such a magazine which is more easily loaded, more easily adjusted for different fastener lengths, and which can be mounted closer to the handle of the fastener driving tool for better tool balance.

BACKGROUND ART

Prior art workers have devised a number of different magazines for fastener driving tools wherein the fasteners are arranged in tandem in strips which are coiled. Such an arrangement generally increases the number of fasteners which can be accommodated by the magazine, as compared to the capacity of a typical linear magazine. There are various types of fasteners which can be arranged in coiled strips. Nails are probably the most common fastener found in coiled form. For this reason, and for purposes of an exemplary showing, the magazine of the present invention will be described in its application to a nail driving tool. It will be understood, however, that the nature of the fastener is not a limitation of the present invention.

The nails of a strip are arranged and held in a tandem row by any appropriate coilable means. These means may constitute tape means, paper means, wire means, plastic means or the like, all of which are well known in the art.

Most prior art canister-type magazines are characterized by a fixed, under-the-handle platform or support surface for the fastener coil, making loading more difficult. Furthermore, while many such prior art magazines have been provided with an adjustable platform or support surface for the accommodation of fasteners of various lengths, the adjustment of the support surface frequently has required disassembly of the magazine.

U.S. Pat. No. 4,585,154 teaches a canister-type magazine made up of three parts: a mounting part, a coil supporting part, and a cover part. The mounting part is affixed to the fastener driving tool and comprises approximately one-half of the magazine's cylindrical side. The fastener coil mounting part comprises a bottom and a significant portion of the magazine sidewall. The two elements can be adjustably joined together and held together by an over center latch. The mounting part also supports a cover part or lid which is pivotable between a magazine closing position and a magazine opening position. From the standpoint of loading, the magazine is fixed with respect to the tool and loading is accomplished from beneath the tool handle. To adjust for fasteners of different lengths, the mounting part and the fastener coil supporting part must be disassembled and reassembled.

U.S. Pat. No. 4,669,648 is also exemplary of prior art structures. Here, a canister-type magazine is provided which is made up of two parts hinged together. Each of the parts comprises approximately one-half of the magazine side, one-half of the magazine bottom and one-half of the magazine top. One of the parts is fixed to the tool. The patent teaches several embodiments of platform or support surface for a coil of fasteners. In a first embodiment, the magazine halves are provided with internal corresponding grooves. A separate platform or supporting surface is engaged in corresponding grooves of both halves, the grooves having been selected with regard to the length of the fasteners of the coil. In a second embodiment, the platform constitutes a separate member pivotally mounted on a shaft which is parallel to the hinge pin of the hinge by which the two magazine halves are joined together. The platform or support surface is adjustable on its pivot pin to accommodate fasteners of various lengths. In the loading operation for the first embodiment, the movable half of the magazine is swung to an open position. The support surface is engaged in the appropriate groove of the fixed half of the magazine and the coil is slipped onto the support surface, whereupon the other magazine half is swung to its closed position. In the second embodiment where the support surface is, itself, pivotally mounted, the movable magazine half is swung to its fully open position and the support surface is swung out from under the top portion of the fixed magazine half for purposes of loading. When the coil is located on the support surface, the support surface is swung into the fixed magazine half, whereupon the movable magazine half is pivoted to its closed position.

The present invention is directed to a fastener coil magazine which is easier to load and adjust than the prior art magazines of this general type. The magazine of the present invention is made up of a fixed pan and a movable pan. The fixed part is attached to the fastener driving tool and the movable part is swingable out from under the tool handle and contains the fastener coil support surface. This makes loading of the magazine very much easier. Since the loading is conducted at a position of the fastener coil support out-from beneath the fastener driving tool handle, the need for space directly below the handle is eliminated, and the magazine assembly can be located closer to the fastener driving tool handle, improving the balance of the tool. The fastener coil support surface is readily adjustable to accommodate various lengths of fasteners without any disassembly of the magazine and the magazine support surface is easily locked in adjusted position. Finally, the magazine of the present invention is made up of molded plastic parts which are easily assembled and light in weight.

DISCLOSURE OF THE INVENTION

According to the invention there is provided a canister-type magazine for a fastener driving tool which utilizes a coil of tandemly arranged fasteners. The magazine comprises a substantially cylindrical body having a top, a bottom, and a side wall. The body is made up of a fixed pan and a movable pan. The fixed body part has a forward end attachable to the tool fastener feed mechanism, and a rearward end attachable to the tool handle. The fixed body pan provides the top and a segment of the side wall of the magazine. The movable body part has forward and rearward ends and provides the bottom, a fastener coil support surface, and the remainder of the side wall of the magazine. The movable body member is pivotally affixed at its rearward end to a hinge member. The hinge member is adjustably and slidably mounted in a hinge member support constituting a portion of the rearward end of the fixed body part. The hinge member is axially shiftable with respect to the hinge member support enabling adjustment of the fastener coil support surface for accommodation of fasteners of different lengths and is lockable in a plurality of adjusted positions.

The movable body part is swingable about its pivotal connection to the hinge member between a closed position and an open position. The movable body part is spring biased to its open position. When the movable body part is in its open position, the fastener coil support surface is out from beneath the tool handle and is fully accessible for loading. When the movable body part is in its closed position, its forward end cooperates with the forward end of the fixed body part to provide a channel for guiding the fasteners into the tool fastener feed mechanism.

DETAILED DESCRIPTION OF THE INVENTION

Figure 1:
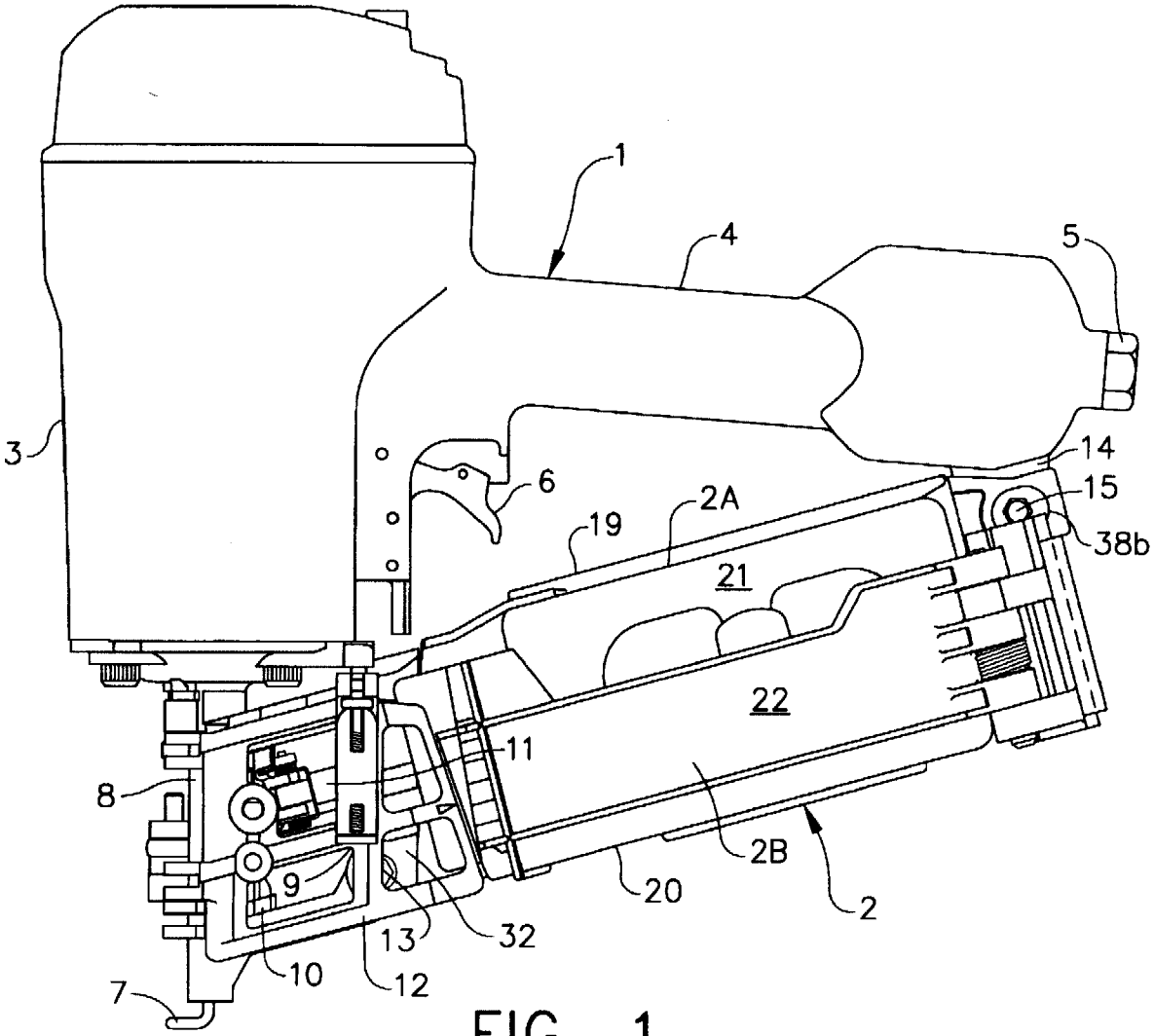
FIG. 1 is a side elevational view of an exemplary fastener driving tool provided with the canister-type magazine of the present invention.
Figure 3:
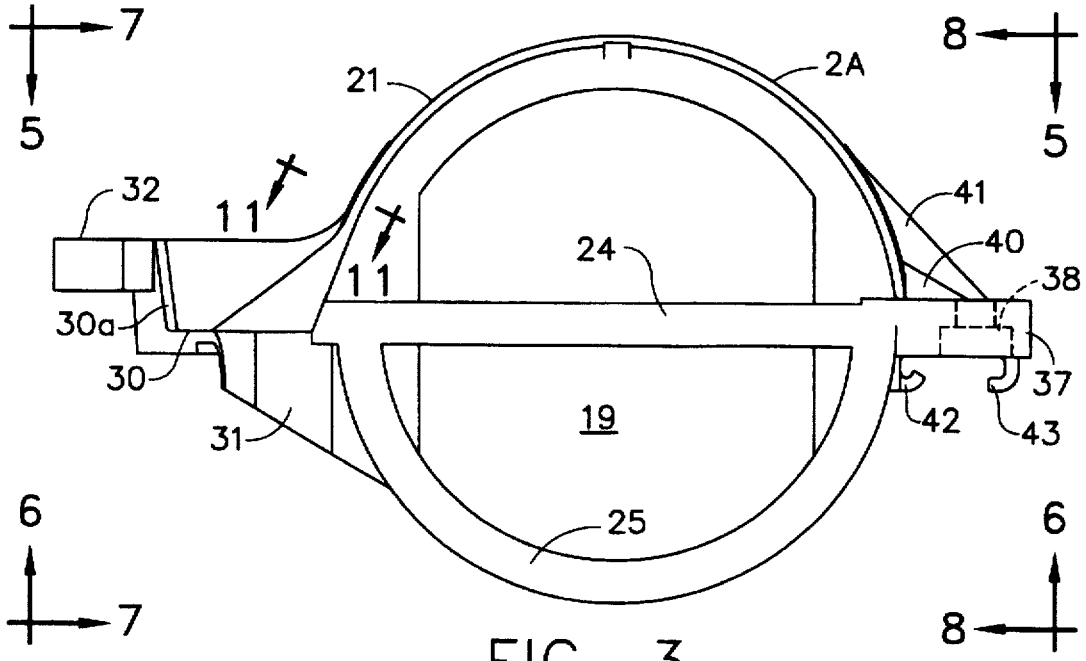
FIG. 3 is a top plan view of the fixed body part of the canister-type magazine of the present invention.
Figure 4:
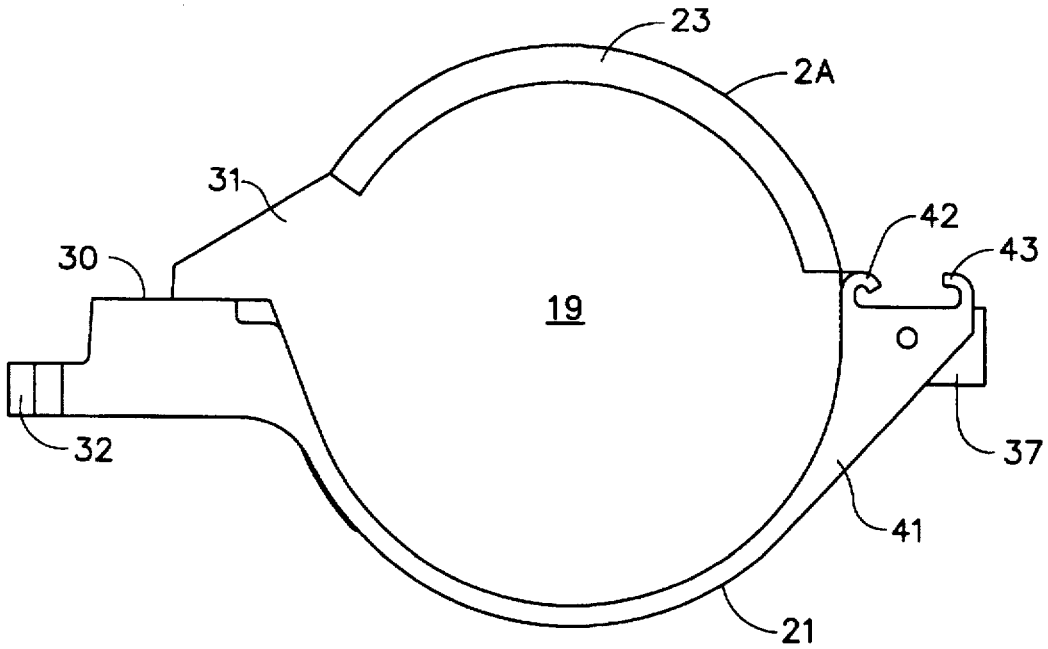
FIG. 4 is a bottom view of the fixed body part of the canister-type magazine of the present invention.

Throughout the specification like parts have been given like index numerals. Reference is first made to FIG. 1 which illustrates an exemplary fastener driving tool, generally indicated at 1, provided with a magazine of the present invention, generally indicated at 2. The tool 1 has a main body part 3 and a body part 4 constituting a handle for the tool.

As is well known in the art, the main body portion 3 of tool 1 contains a cylinder (not shown) having a piston/driver assembly (not shown) therein. A part of the main body portion 3 and the handle portion 4 constitute a reservoir for air under pressure. The air under pressure is introduced into the reservoir by a hose (not shown) connected to a source of compressed air (not shown). The hose is attached to the fitting 5 of handle 4. The piston/driver assembly of the tool cylinder is actuated to drive a fastener by means of a normally closed main valve (not shown) at the top of the cylinder. The valve may be opened (permitting high pressure air to actuate the piston/driver assembly to drive a fastener) by means of a remote valve (not shown) which is actuated by the tool trigger 6. The trigger 6 is usually enabled by a safety trip 7, when the safety trip 7 is pressed against a workpiece.

Beneath the main body portion 3 of tool 1 there is a guide body 8. The guide body 8 contains a drive track (not shown) to accommodate a fastener to be driven and the lower end of the piston/driver assembly.

The tool 1 is provided with a feed mechanism, generally indicated at 9. The feed mechanism may take any appropriate form. A usual and well-known feed mechanism for this purpose comprises a pawl assembly 10 actuable by an air cylinder 11. After each cycle of the tool, the pawl assembly will engage at least one nail near the forwardmost nail of the coiled strip thereof and pull the strip incrementally from the magazine 2, locating the forwardmost nail of the strip in the drive track of the guide body 8. The feed mechanism 9 is provided with a releasably lockable closure gate 12 which maintains the forward portion of the fastener strip properly positioned for engagement by the pawl assembly. As will be more clearly described hereinafter, the magazine 2 is made up of a fixed body part 2A and a movable body part 2B. The fixed body part 2A has a forward end which is affixed to feed mechanism 9 by a bolt, as at 13. The fixed body pan 2A has a rearward end which is affixed to a downwardly depending lug 14 on tool handle portion 4 by a bolt, as at 15. In operation, the tool is cycled, and at the end of the cycle the pawl assembly 10 is actuated by the air cylinder 11 to pull and increment of the strip of nails from canister 2 and to introduce into the guide body drive track the forwardmost nail of the coiled nail strip. It will be noted that the movable part 2B of magazine 2 is hinged at its rearward end. The forward end is engaged by the feed mechanism gate releasably maintaining the magazine body part 2B in its normal, closed position.

Figure 2:
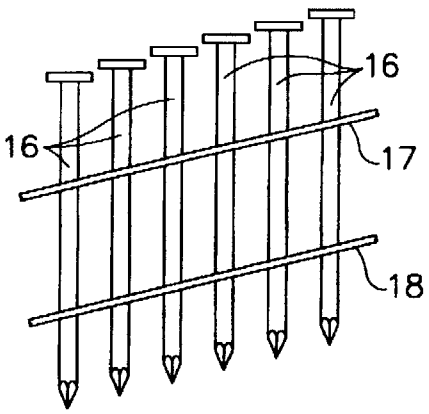
FIG. 2 is a fragmentary elevational view of an exemplary coilable fastener strip.

FIG. 2 is a fragmentary elevational view illustrating a plurality of fasteners 16, in this instance headed nails, arranged in a tandem row and joined together to form a strip by means of such nature that the strip can be coiled. In this example, a pair of frangible wires 17 and 18 are welded to the shank of each nail. As indicated above, there are other nail joining means for maintaining a series of nails in a coilable strip including tape means, paper means, plastic means and the like, all of which have long been known in the art.

Referring again to FIG. 1, the canister 2 with its fixed and movable body parts 2A and 2B constitutes a substantially cylindrical structure having a top 19, a bottom 20 (which provides a fastener coil support surface to be described hereinafter), together with a curved side wall made up of segments 21 and 22. The fixed body part 2A of canister 2 is shown in FIGS. 3–11.

Turning first to FIGS. 3–6, the stationary body part 2A of canister 2 comprises the substantially circular top 19 and the circular wall segment 21. As can be clearly seen in FIG. 4, the inside surface of top 19; along the wall-free peripheral portion thereof, has a narrow band 23 which slopes upwardly and outwardly (see also FIGS. 6–8). The cantilevered part of the top 19 may be additionally strengthened by a transverse rib 24 and a peripheral rib 25, best shown in FIG. 3.

Figure 5:
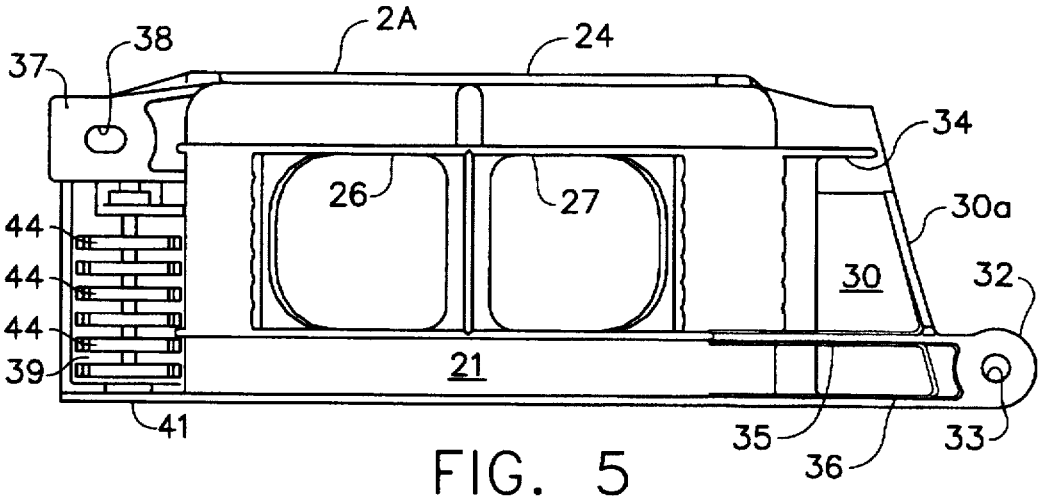
FIG. 5 is an elevational view of the exterior of the fixed body part as viewed from the line 5—5 of FIG. 3.
Figure 6:
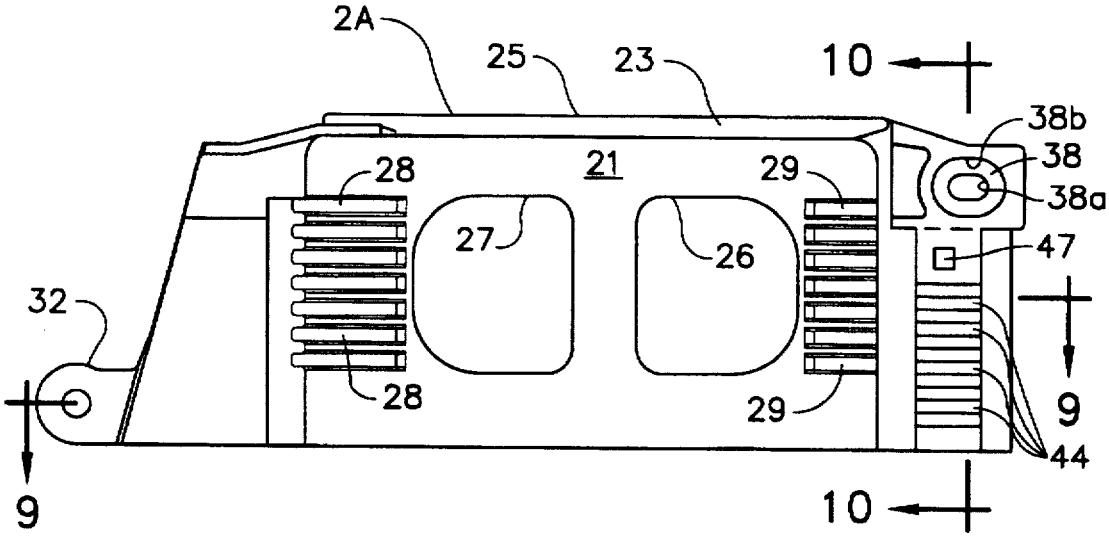
FIG. 6 is an interior elevational view of the fixed body part as viewed from line 6—6 of FIG. 3.
Figure 7:
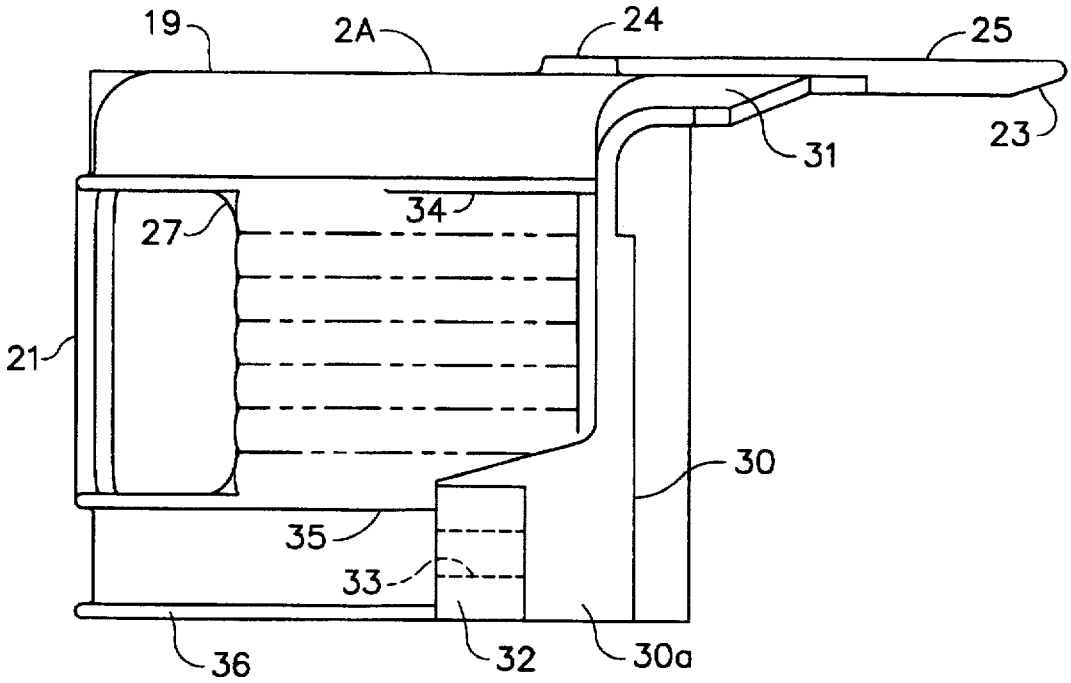
FIG. 7 is a front elevational view of the fixed body part as viewed from line 7—7 of FIG. 3.

Side wall segment 21 may have a pair of windows 26 and 27 formed therein and best shown in FIGS. 5 and 6. The windows 26 and 27 not only enable the coil of fasteners to be seen when mounted in magazine 2, but also serve to reduce the weight of the fixed body part 2A. Near its forward end, wall segment 21 has a series of evenly spaced horizontal grooves 28 formed therein. Near its rearward end, wall segment 21 has a similar set of evenly spaced horizontal grooves 29. The grooves 28 and 29 are equal in number and are aligned. The grooves 28 are shown in cross-section in FIG. 11. It will be understood that the grooves 29 will have a similar cross-section. The purpose of grooves 28 and 29 will be apparent hereinafter.

Near the forward end of fixed body part 2A, the wall segment 21 terminates in a planar forwardly extending portion 30. The wall portion 30 is surmounted by a forwardly directed extension 31 of top 19, the purpose of which will be apparent hereinafter. The wall 30 terminates in a laterally extending wall 30*a* which supports an attachment lug 32 having a transverse perforation 33. The entire forwardly extending assembly thus far described is reinforced by a series of webs most clearly shown in FIG. 5 at 34, 35 and 36. It will be remembered from the description of FIG. 1 above that the forward end of magazine 2 is bolted to the fastener feed mechanism 9 by bolt 13. Bolt 13 passes through the hole 33 in lug 32 of fixed body part 2A.

At the rearward end of the fixed body part 2A of magazine 2 there is a rearwardly extending lug 37 having an elongated hole 38 formed therethrough. As is clearly shown in FIG. 8, for example, the elongated hole 38 in lug 37 has a first portion 38A and a second portion 38B of greater transverse dimension. The bolt 15 (see FIG. 1) by which the rearward end of magazine 2 is affixed to the lug 14 of tool handle 4 passes through the hole 38 of lug 37 with the head of bolt 15 recessed in the larger hole portion 38B.

Figure 8:
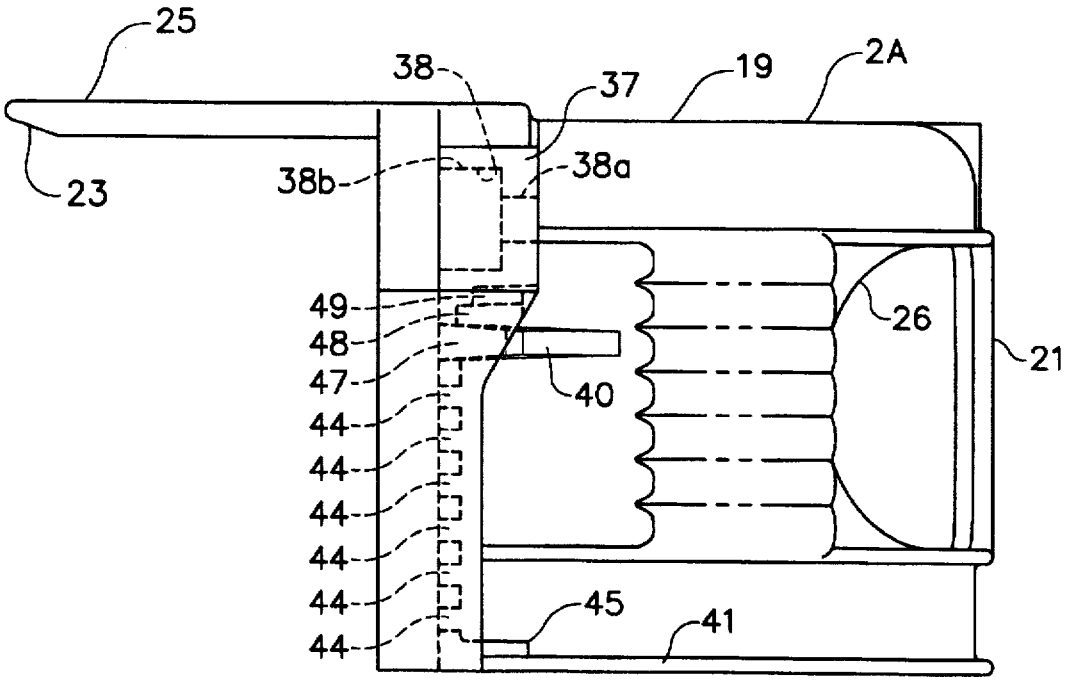
FIG. 8 is a rear elevational view of the fixed body part as viewed from line 8—8 of FIG. 3.
Figure 9:
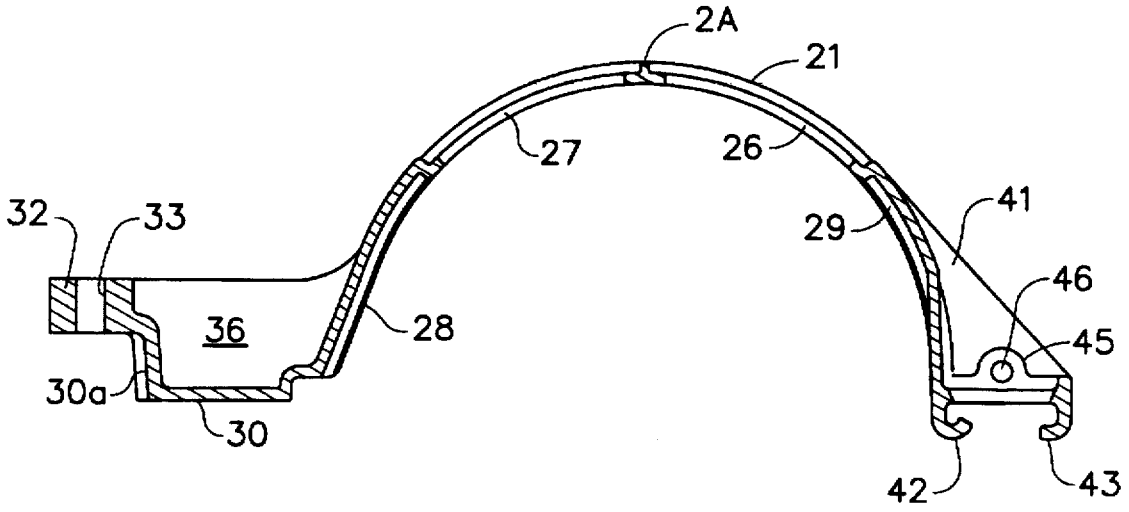
FIG. 9 is a cross-sectional view taken along section line 9—9 of FIG. 6.
Figure 10:
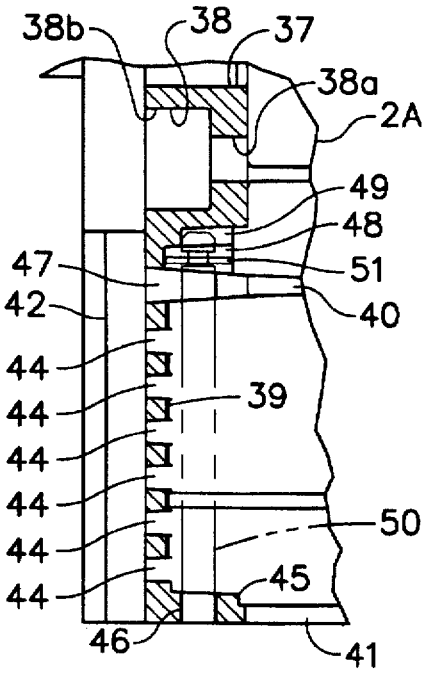
FIG. 10 is a fragmentary cross-sectional view taken along section line 10—10 of FIG. 6.
Figure 11:
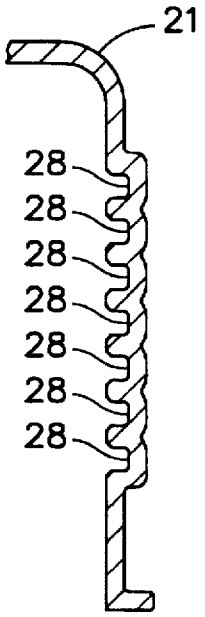
FIG. 11 is a fragmentary cross-sectional view taken along section line 11—11 of FIG. 3.

Beneath lug 37 there is a downwardly depending panel 39, best shown in FIGS. 8 and 10. The panel 39 is reinforced by horizontal webs 40 and 41 shown in FIGS. 3–5 and 8. That side of panel 39 opposite reinforcing webs 40 and 41 is flanked by a pair of channel forming elements 42 and 43, the purpose of which will be apparent hereinafter.

Panel 39 contains a series of transverse horizontal, evenly spaced slots 44. The ends of the slots flare outwardly with respect to that side of panel 39 reinforced by webs 40 and 41. This is clearly shown at 44A in FIGS. 31 and 32, to be described hereinafter.

Referring primarily to FIG. 10, it will be noted that the web 41 has an additional reinforcing thickness adjacent panel 39. This additional thickness is indicated at 45 in FIG. 10 and is also clearly shown in FIG. 9. The web 41 and its additional thickness 45 are provided with a bore 46. A slot 47 extends through panel 39 and into reinforcing web 40. The panel 39, immediately above reinforcing web 40 has a chamber 48 formed therein, followed by a somewhat smaller chamber 49. This last mentioned structure is intended to accommodate the shaft of the cam lock to be described hereinafter. The shaft is shown at 50 in FIG. 10 and passes through the hole 46 in reinforcing web 41 and its additional thickness 45. The shaft 50 also passes through the slot 47 formed in panel 39 and reinforcing web 40. The upper end of the shaft extends through chamber 48 and into chamber 49. That portion of shaft 50 located in chamber 48 is provided with an annular groove adapted to receive a retaining ring 51, which retains shaft 50 in place.

Reference is now made to FIGS. 12–17, wherein the movable body part 2B of magazine 2 is illustrated. The movable body part 2B provides the bottom 20 of magazine 2 together with wall segment 22 which substantially surrounds the periphery of the bottom 20. The wall segment 22 is configured and sized to fit within wall segment 21 of fixed body part 2A. As is most clearly shown in FIG. 12, the movable body part 2B is provided with a pair of peripheral lugs 52 and 53 adapted to engage in any corresponding pair of the slots 28 and 29, respectively, of the fixed body part 2A. This provides sufficient support for the movable body part 2B that it will not sag under the weight of a fastener coil.

The movable body part 2B has near its rearward end a set of three hinge elements having coaxial bores 57, 58 and 59 formed therein. The bottom 20 of the movable body part 2B is provided with a series of reinforcing ribs, generally indicated at 60, and best shown in FIG. 13. The inside surface 61 of bottom 20 constitutes a support platform or surface for a fastener coil. To keep a fastener coil properly centered on support surface 61, the movable body part 2B has a central, upstanding, slightly tapered spindle 62, about which a fastener coil can be located.

Figure 12:
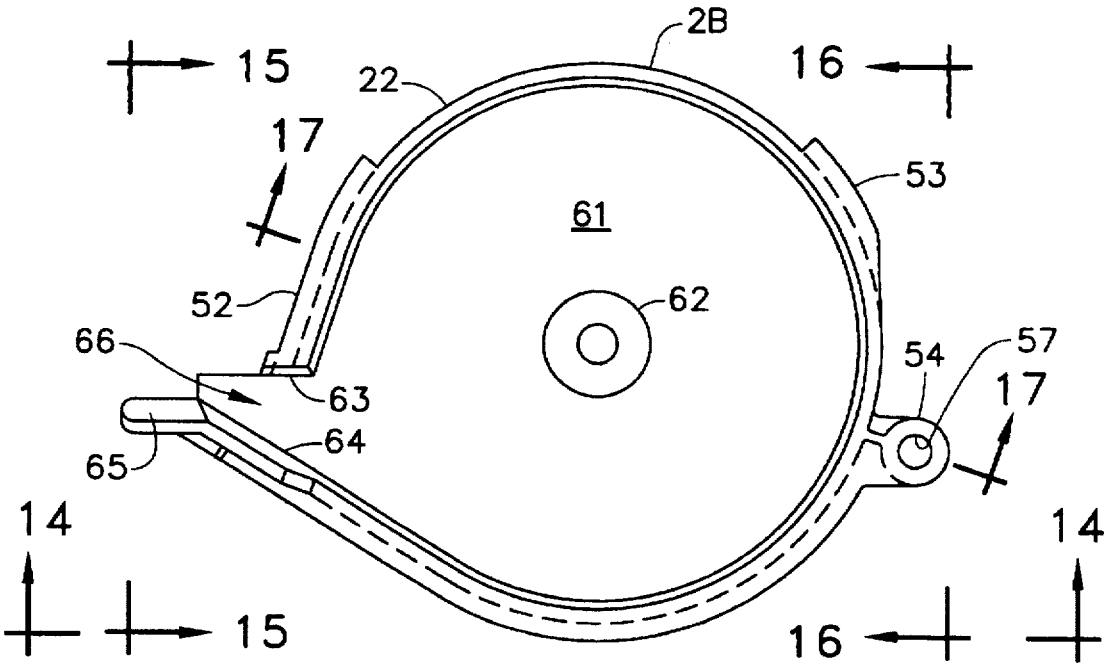
FIG. 12 is a top plan view of the magazine movable body part.
Figure 13:
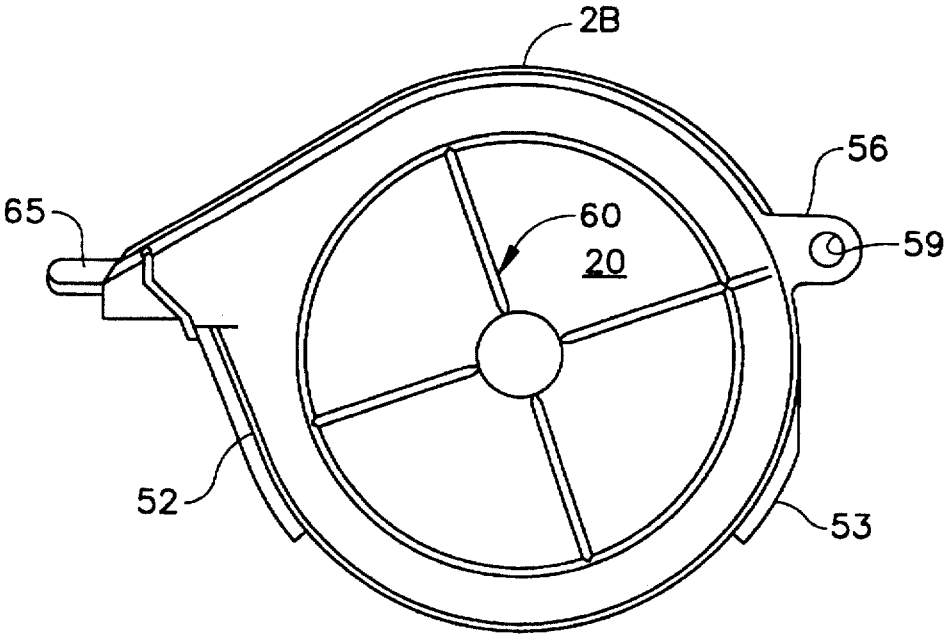
FIG. 13 is a bottom view of the magazine movable body part.
Figure 14:
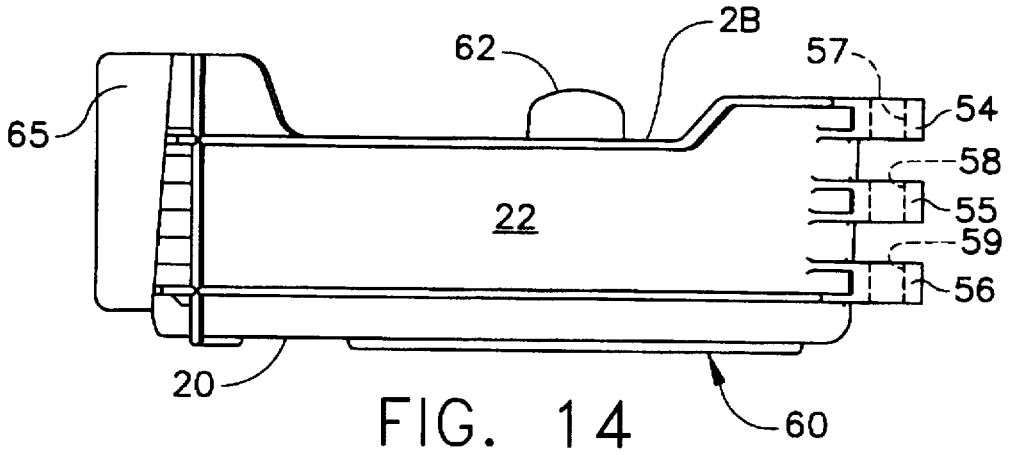
FIG. 14 is a side elevational view of the structure of FIG. 12 as seen along line 14—14 of that Figure.
Figure 15:
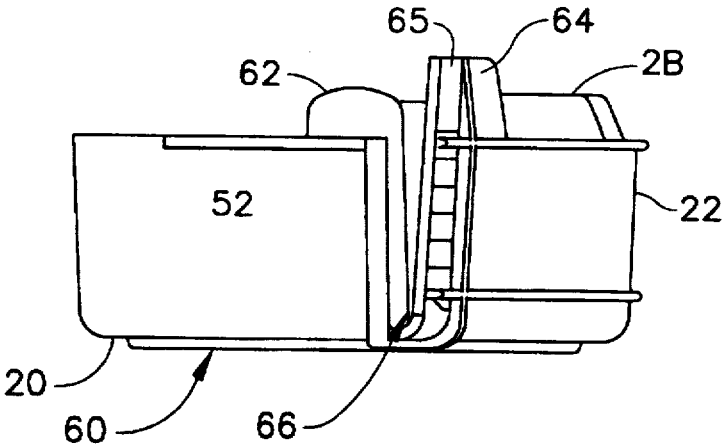
FIG. 15 is a front elevational view of the structure of FIG. 12 as seen along line 15—15 of that Figure.
Figure 16:
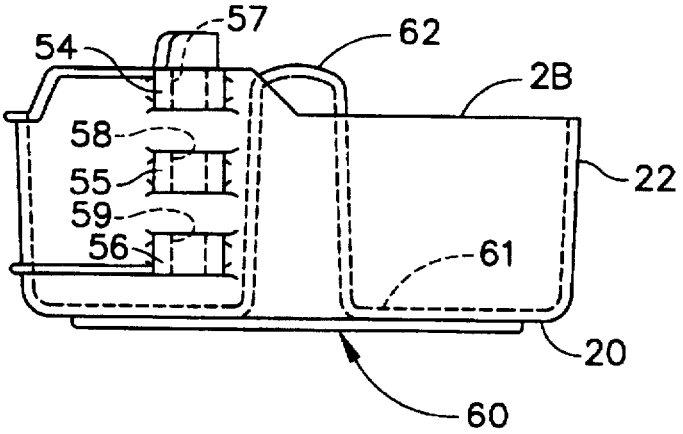
FIG. 16 is a rear elevational view of the structure of FIG. 12 as seen from line 16—16 of that Figure.
Figure 17:
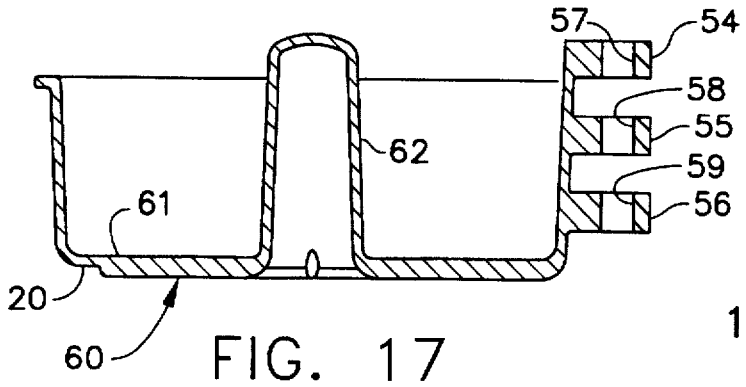
FIG. 17 is a cross-sectional view taken along section line 17—17 of FIG. 12.

Turning to FIG. 12, it will be noted that the wall segment 22 of movable body portion 2B terminates at one end in a short forwardly extending wall portion 63. When the movable body portion 2B is in its closed position with respect to the fixed body portion 2A, the wall 63 will be substantially coextensive with the wall portion 30 of fixed body portion 2A, forming one side of a sort of channel directing the fasteners of the coil into tool feed mechanism 9.

The other end of wall segment 21 terminates in a vertically enlarged wall portion 64 which, itself, terminates in a wall extension or tab 65, lying at an angle of about 86° with respect to coil support surface 61. The wall portions 64 and 65 serve as the second side of the fastener guiding channel. The channel is generally indicated at 66 in FIG. 12. When the movable part 2B of magazine 2 is in its closed position, it is maintained in its closed position by the releasably lockable gate 12 of feed mechanism 9 which abuts against the outside surface of tab 65.

Figure 18:
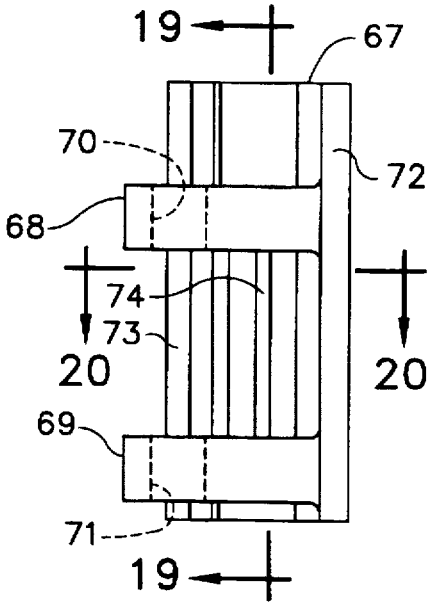
FIG. 18 is a rear elevational view of the hinge member of the present invention.
Figure 19:
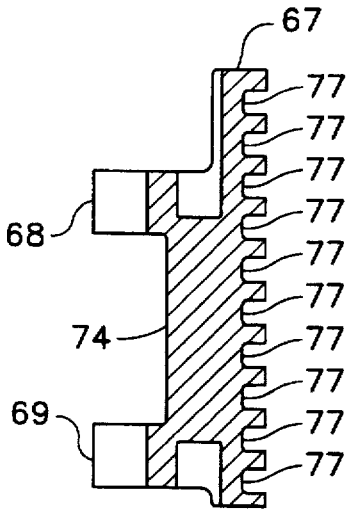
FIG. 19 is a cross-sectional view taken along section 19—19 of FIG. 18.
Figure 20:
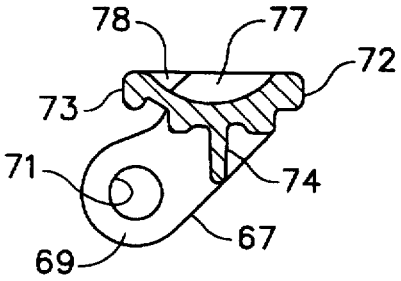
FIG. 20 is a cross-sectional view taken along section 20—20 of FIG. 18.

The hinge member 67 of the present invention is illustrated in FIGS. 18–21. The hinge member 67 is shown from the rear in FIG. 18. The hinge member has a pair of off-set hinge elements 68 and 69 provided with coaxial bores 70 and 71, respectively. FIG. 20 is a cross-sectional view taken along section line 20—20 of FIG. 18. FIG. 20 illustrates the cross-sectional configuration of the rear surface of hinge member 67. It will be noted that the right hand edge portion 72 of hinge member 67, as viewed in FIGS. 18 and 20, is configured to be received within the channel forming element 43 of the fixed body portion 2A. Similarly, the left-hand edge 73 of hinge member 67 is configured to be received within the channel forming element 42 of the fixed body part 2A. In this way, the hinge member 67 is axially slidable with respect to panel 39 of the fixed body part 2A. The rear surface of the hinge member, between hinge elements 68 and 69, is provided with a fin-like brace or strengthening member 74.

Figure 21:
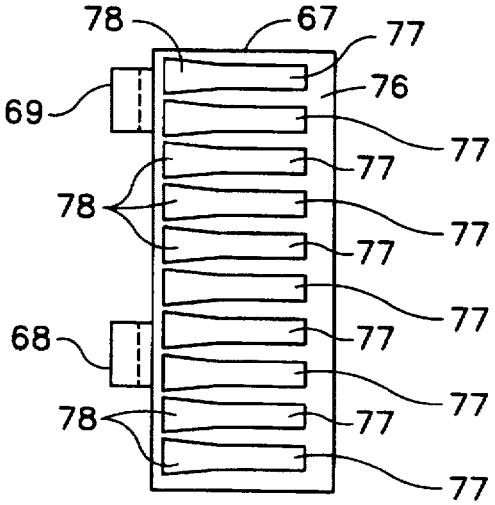
FIG. 21 is a front elevational view of the hinge member.
Figure 22:
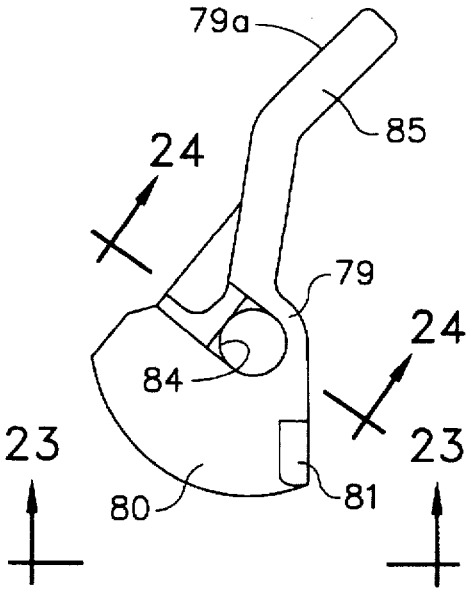
FIG. 22 is a top plan view of the cam lock of the present invention.
Figure 23:
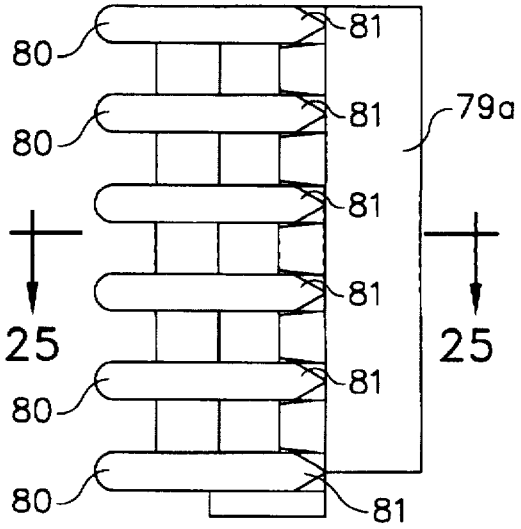
FIG. 23 is an elevational view of the cam lock of FIG. 22 as seen from line 23—23 of that Figure.
Figure 24:
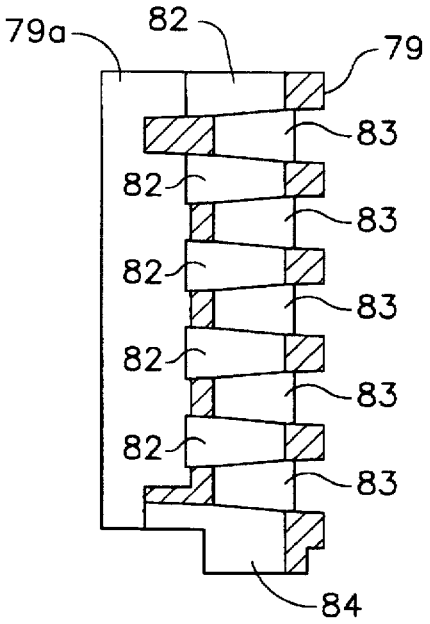
FIG. 24 is a cross-sectional view taken along section line 24—24 of FIG. 22.
Figure 25:
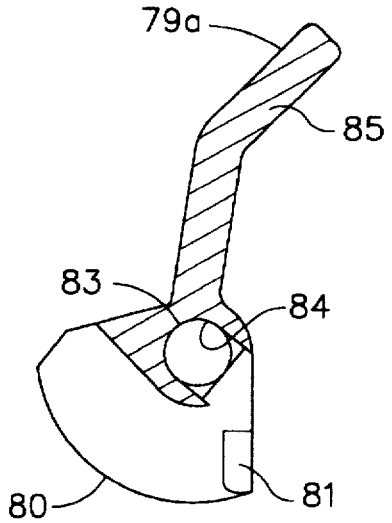
FIG. 25 is a cross-sectional view taken along section line 25—25 of FIG. 23.

As is shown in FIGS. 19 and 21, the hinge member has a forward face 76 in which there is formed a plurality of transverse grooves 77. The grooves 77 are identical and are evenly spaced from each other. Each of the grooves 77 is arcuate, as shown in FIG. 20. Finally, each of the grooves 77 has an entrance end 78 which is slightly flared, as is clearly shown in FIGS. 20 and 21. The purpose of the grooves will be apparent hereinafter.

A cam lock is indicated at 79*a* in FIGS. 22–25. The cam lock has a body portion 79 provided with a number of arcuate engagement members adapted to be received in selected ones of the transverse slots 77 of the hinge member 67, as will be more fully described hereinafter. Each of the arcuate engagement members 80 is provided with a tapered entrance edge 81 to facilitate its entrance into one of the hinge member slots 77. The main body portion 79 has a series of alternate oppositely directed notches formed therein such as notches 82 illustrated in FIGS. 22 and 24 and notches 83 illustrated in FIGS. 24 and 25. The oppositely directly notches 82 and 83 in the central body portion 79 of the cam lock form an axial bore, generally indicated at 84 and adapted to receive the shaft 46 illustrated in FIG. 10, as will be more fully described hereinafter. The cam lock is completed by the provision of a handle 85 by which the cam lock may be manually rotated between a locking position and an unlocking position.

Figure 26:
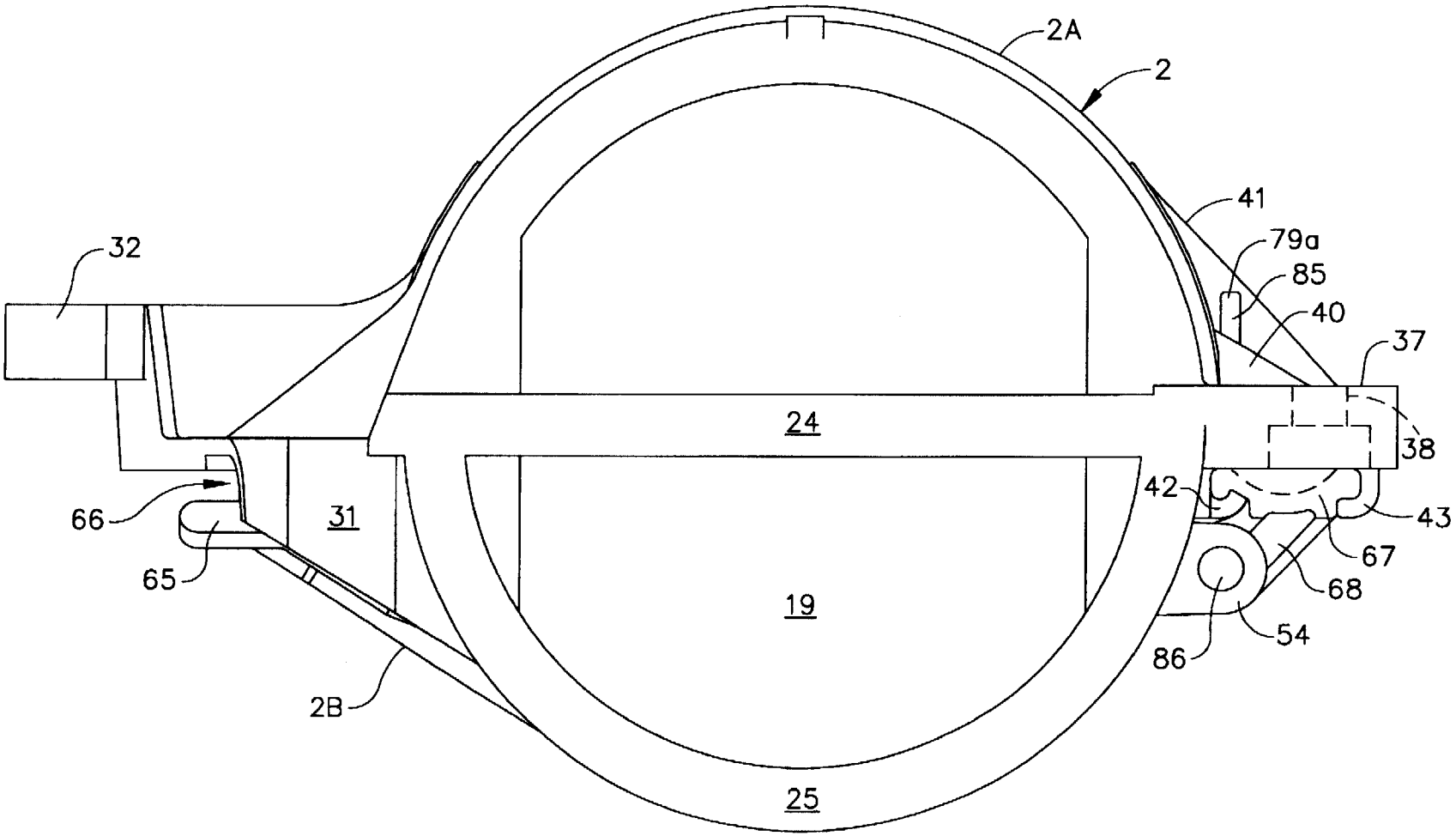
FIG. 26 is a top plan view of the complete canister-type magazine of the present invention in its closed condition.
Figure 27:
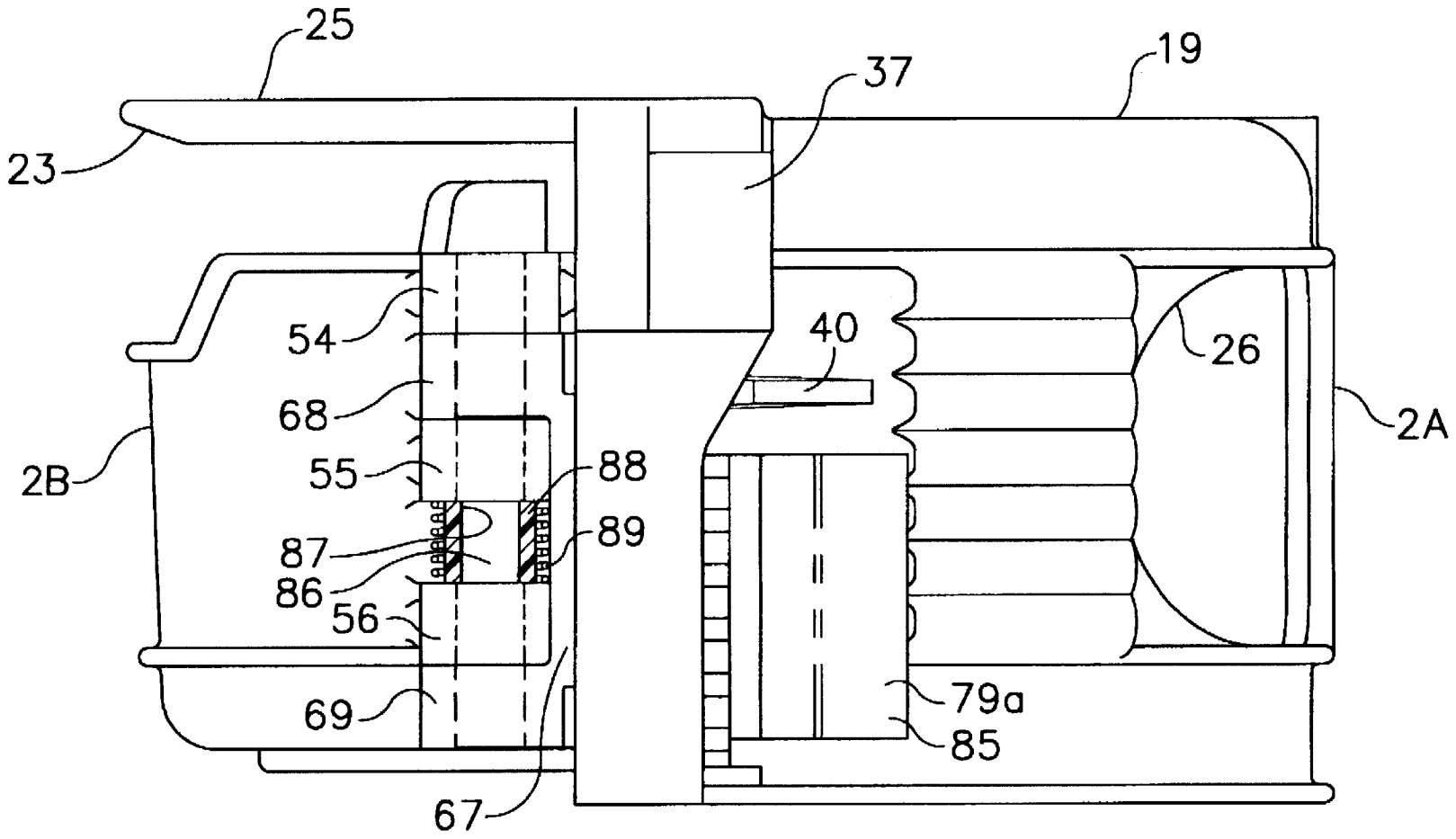
FIG. 27 is a rear end elevational view of the structure of FIG. 26, as seen from the fight of that Figure.

The major parts of the magazine of the present invention having been described, reference is now made to FIGS. 26 and 27 wherein the magazine 2 is shown fully assembled. In both Figures, the movable body part 2B of magazine 2 is shown in its closed position. It will be apparent from FIGS. 26 that the magazine body parts 2A and 2B cooperate to form a guidance channel 66 for introduction of the forward end of the coiled fastener strip into the feed mechanism 9 of the tool 1.

At the rearward end of magazine 2, it will be noted that the hinge member is mounted between and within the channel forming elements 42 and 43 of the fixed magazine body part 2A. It will be noted that the hinge elements 68 and 69 of the hinge member 67 are inter-digitated with the hinge elements 54, 55 and 56 of the movable body part 2B of magazine 2. Hinge element 68 of hinge member 67 is located between hinge elements 54 and 55 of movable body part 2B. Hinge element 69 of hinge member 67 is located beneath hinge element 56 of the movable body part 2B. The hinge elements 54, 55, 56, 68 and 69 are pivotally joined together by the pivot pin 86. It will be noted that between hinge elements 55 and 56 of the movable body part 2B the pivot pin has an annular notch 87 formed therein. Surrounding the annular notch 87 there is a cylindrical member 88 of resilient material. This, in ram, is surrounded by a torsion spring 89. In assembly, the resilient cylindrical member 88, surrounded by the torsion spring 89 is located between hinge elements 55 and 56 of the movable magazine body part 2B. The pivot pin 86 is then introduced into the coaxial bores of hinge elements 54, 68, 55, 56 and 69. As pivot pin 86 passes through resilient cylindrical member 88, the cylindrical member 88 is compressed between pivot pin 86 and torsion spring 89. When pivot pin 86 is fully seated in place, its annular notch 87 will be opposite resilient cylindrical member 88 which will be free to expand into the annular notch 87 of pivot pin 86. In this fashion, pivot pin 86 is held in place by the resilient member, as is torsion spring 89. Torsion spring 89 has arms (not shown) which engage the movable magazine body part 2B and the hinge member 67 in such a way as to constantly urge the movable body part 2B to its open position shown in FIG. 28. As indicated heretofore, the movable body part 2B is maintained in its closed position by the gate 12 of the feed mechanism 9 engaging the tab 65 at the forward end of movable body part 2B. It will be noted from FIG. 28 that when the movable body part 2B is in its open position, the support surface 61 of the movable body part 2B is wholly out from under the top 19 of the fixed body part 2A and thus is wholly out from under the handled portion 4 of fastener driving tool 1.

Figure 28:
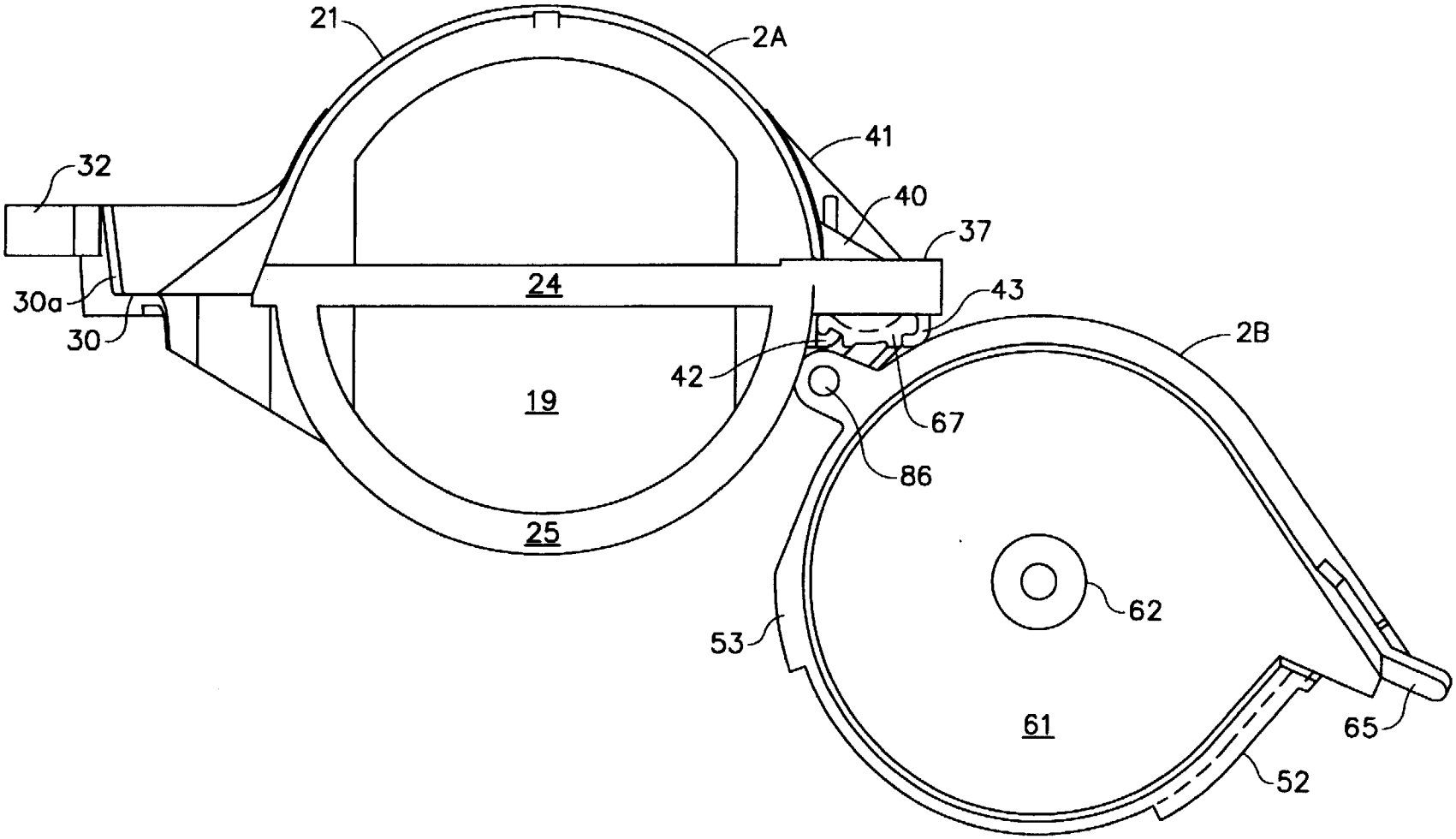
FIG. 28 is a top plan view of the magazine with the movable body part swung to its fully opened position.
Figure 29:
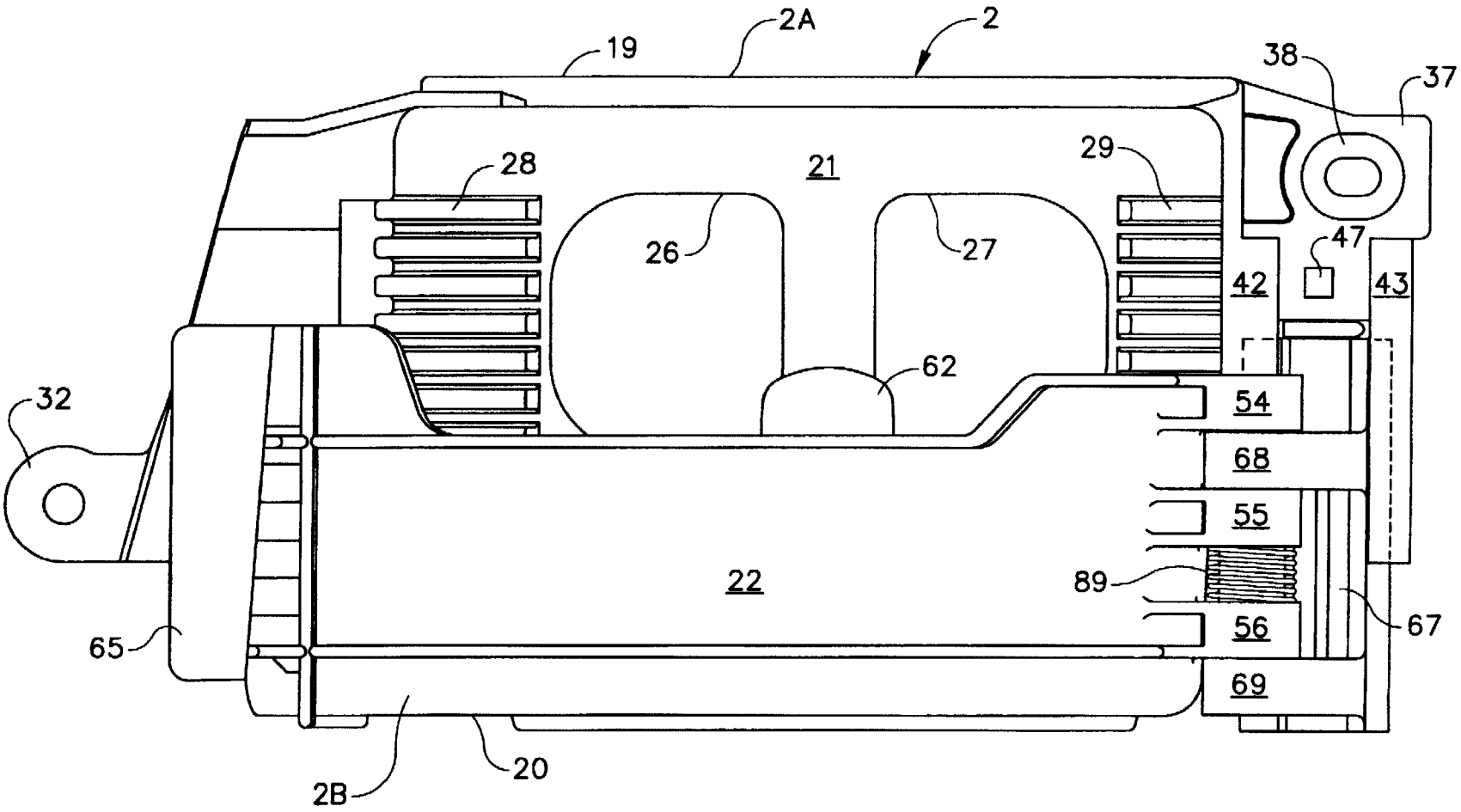
FIG. 29 is a side elevational view of the magazine of FIG. 26, as seen from the fight of that Figure, and showing the magazine movable body part in a lower adjusted position for accommodating fasteners or nails having relatively long shanks.
Figure 30:
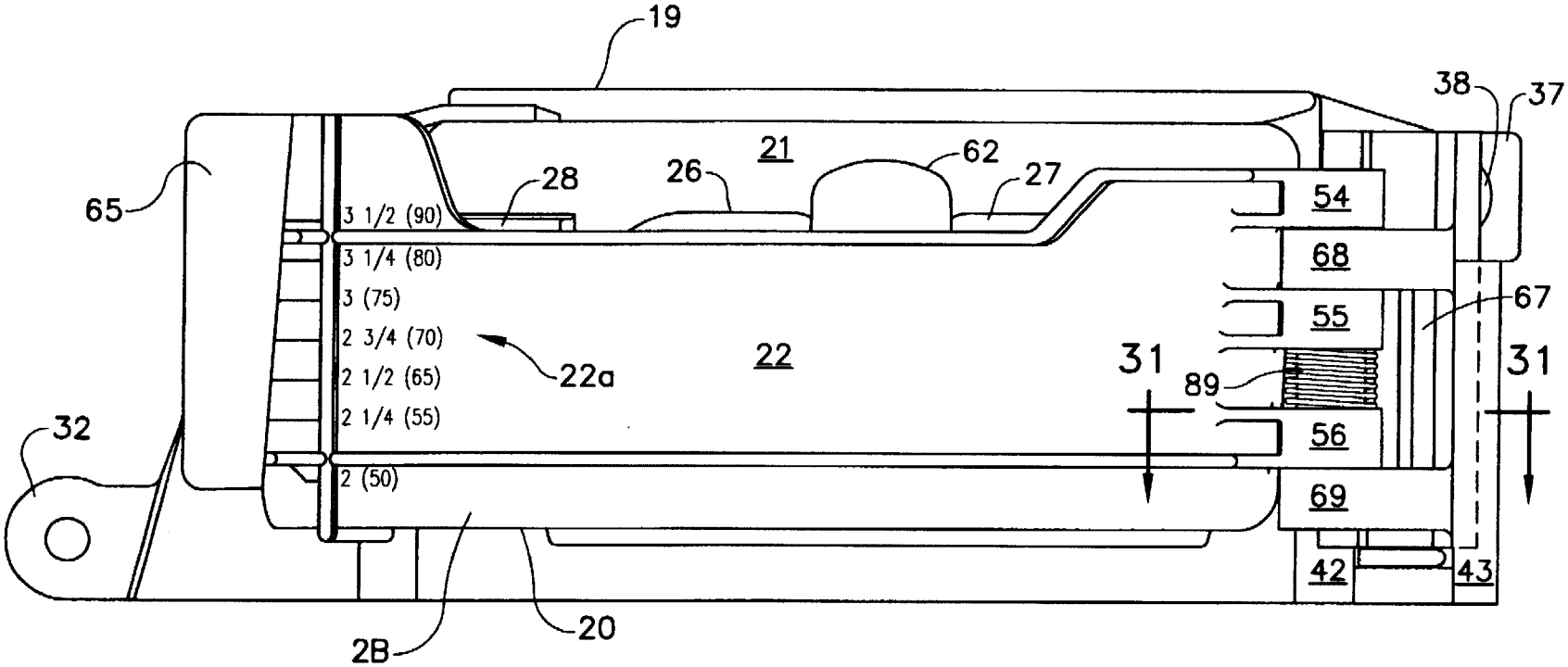
FIG. 30 is a side elevational view, similar to FIG. 29, but illustrating the movable body part in its uppermost adjusted position for fasteners or nails of shorter shank length.

FIG. 29 illustrates the movable body part 2B of the magazine at its lowest position with respect to the fixed body part 2A wherein the magazine 2 can accommodate fasteners of the longest shank capable of being driven by the fastener driving tool 1. FIG. 30 is similar to FIG. 29 and illustrates the movable body part 2B of the magazine 2 in its uppermost position with respect to the fixed body part 2A. In this configuration, the magazine 2 accommodates fasteners of the shortest shank length capable of being driven by the fastener driving tool 1. It will be remembered that the flanges 52 and 53 (see FIGS. 12 and 28) will engage appropriate corresponding ones of the grooves 28 and 29 (see FIGS. 6 and 29) in both the configuration of FIG. 29 and the configuration of FIG. 30, and all other possible positions of the movable body part 2B therebetween. This engagement of the flanges 52 and 53 in the grooves 28 and 29 stabilize the movable body part 2B, preventing any sag thereof due to the weight of the coil of fasteners.

It will be apparent from a comparison of FIGS. 29 and 30 that this shifting of the movable body part 2B with respect to the fixed body part 2A of magazine 2 is accomplished by shifting of the hinge element 67 in channel forming elements 42 and 43. When a desired position of the movable body part 2B of magazine 2 has been selected, it will remain in that position upon the locking of the hinge member 67 in its adjusted position in channel forming elements 42 and 43. The manner in which the hinge member 67 is locked in a desired adjusted position will next be described.

Figure 32:
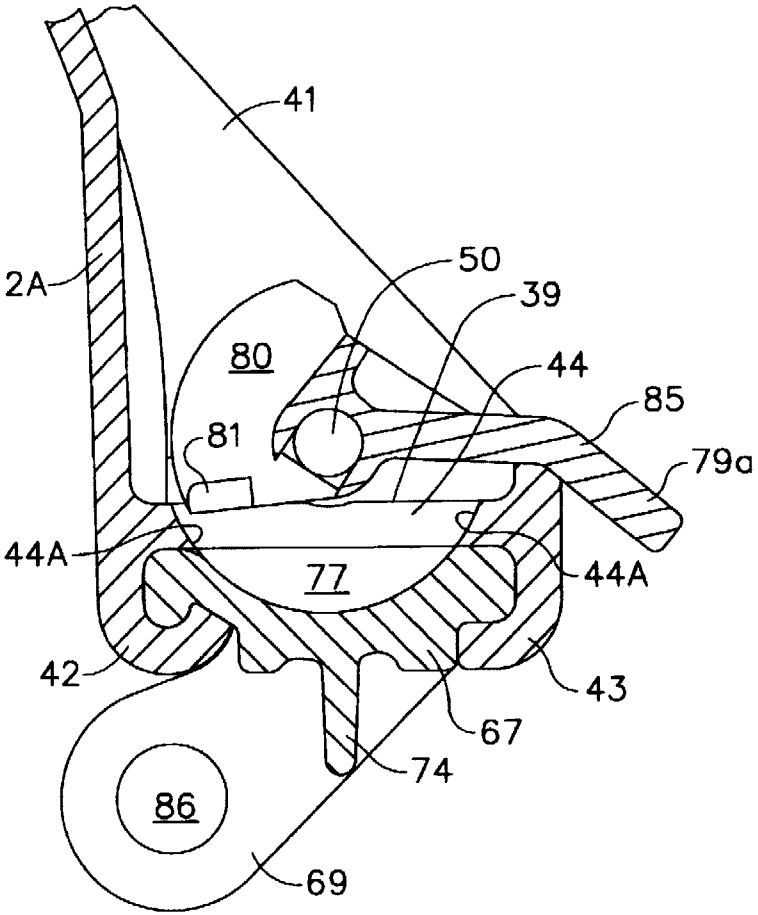
FIG. 32 is a fragmentary cross-sectional view similar to FIG. 31, but illustrating the cam lock in its open, non-latching position.
Figure 31:
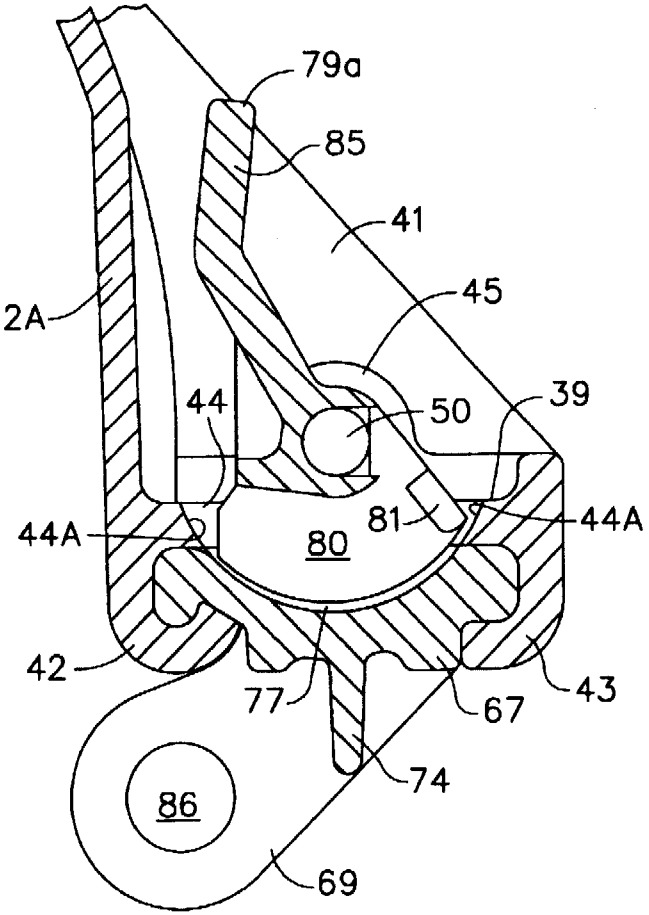
FIG. 31 is a fragmentary cross-sectional view illustrating the hinge member of FIGS. 18–21 located in adjusted position within the hinge member mount of the fixed magazine part and locked in place by the cam lock of FIGS. 22–25.

Referring to FIGS. 10 and 27, the cam lock (of FIGS. 22–25) is pivotally mounted on shaft 50. When so mounted, the arcuate engagement members 80 of the cam lock are aligned with the slots 44 of panel 39 as is illustrated in FIGS. 31 and 32, the cam lock is rotatable between an unlocking position wherein its arcuate engagement members 80 are outside the slots 44 of panel 39, and a locking position wherein each of the cam lock arcuate engagement members 80 extends into and through its respective one of the slots 44 of panel 39.

It will be remembered from FIGS. 19, 20 and 21 that the hinge member 67 has a plurality of arcuate slots 77 formed in its front face 76. Throughout its range of positions in channel forming elements 42 and 43 (i.e. between those positions shown in FIGS. 29 and 30), selected hinge member slots 77 are aligned with selected slots 44 of panel 39. As will be apparent from FIGS. 31 and 32, with the cam lock in its open position, the hinge member is free to slide upwardly and downwardly in the channel forming elements 42 and 43. When the desired position of the hinge member 67 is achieved, the cam lock 78 is rotated to its locking position, with those of its arcuate engagement members 80 aligned with a hinge member slot 77, entering that slot 77. The tapered or relieved portion 81 of each of the cam lock arcuate engagement members 80 help to bring those slots 77 of hinge member 67 to be engaged thereby into alignment with their respective slots 44 of panel 39.

From the above, it will be evident that to change the position of the movable body part 2B of magazine 2, it is only necessary to shift the movable body part 2B to its open position shown in FIG. 28 and thereafter to rotate the cam lock 79*a* to its unlocking position (FIG. 32) whereupon the position of the hinge member 67 can be changed as desired within the channel forming elements 42 and 43. Indicia may be provided on the magazine so that the operator can readily tell in what position the hinge member 67 should be placed for a fastener having a given length. Exemplary indicia is shown at 22*a* in FIG. 30. The change over is quick and easy, and no disassembly of the magazine 2 is required.

Figure 33:
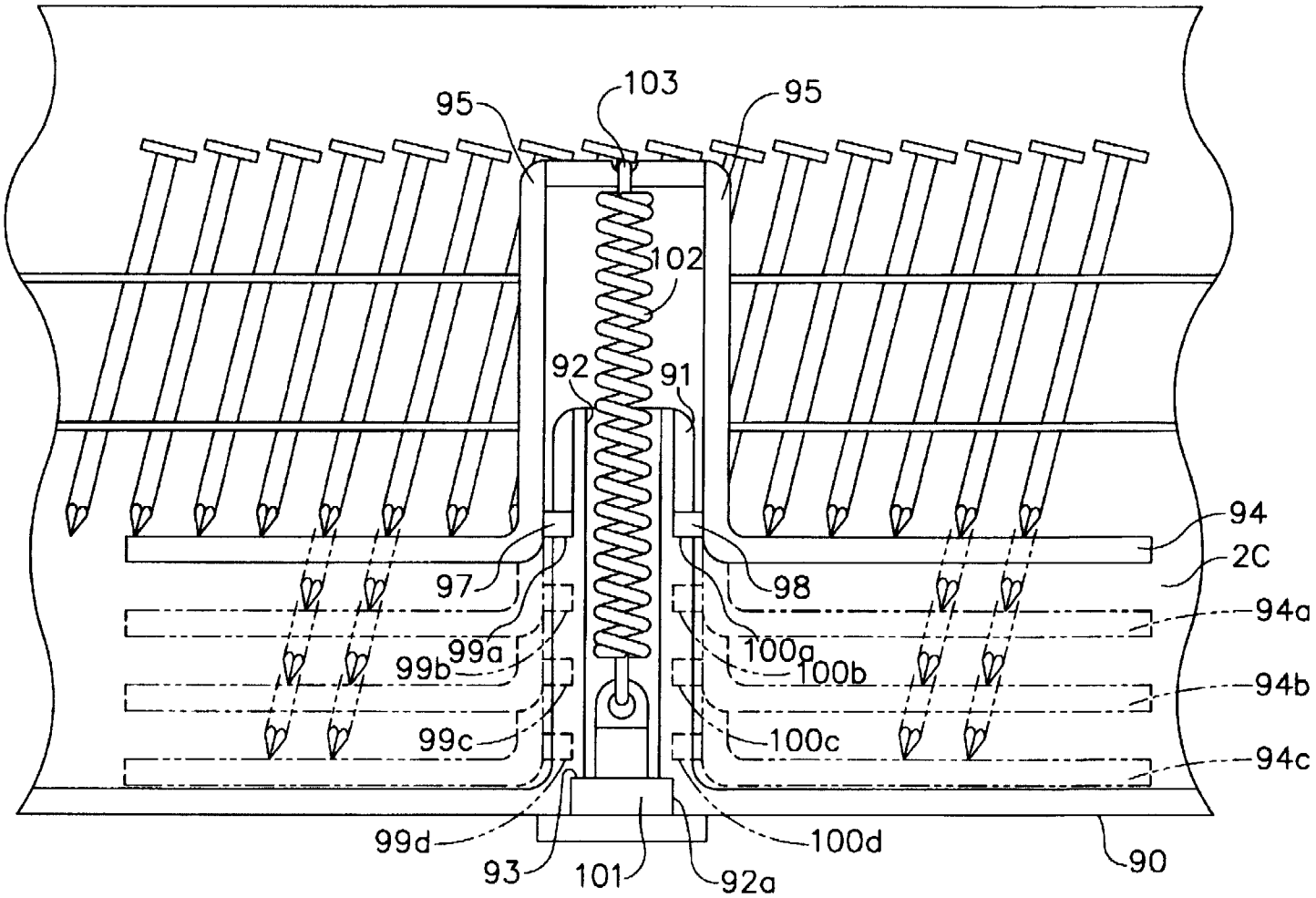
FIG. 33 is a fragmentary, simplified, cross-sectional view illustrating an alternative form of adjustable support surface for the coil of fasteners.
Figure 34:
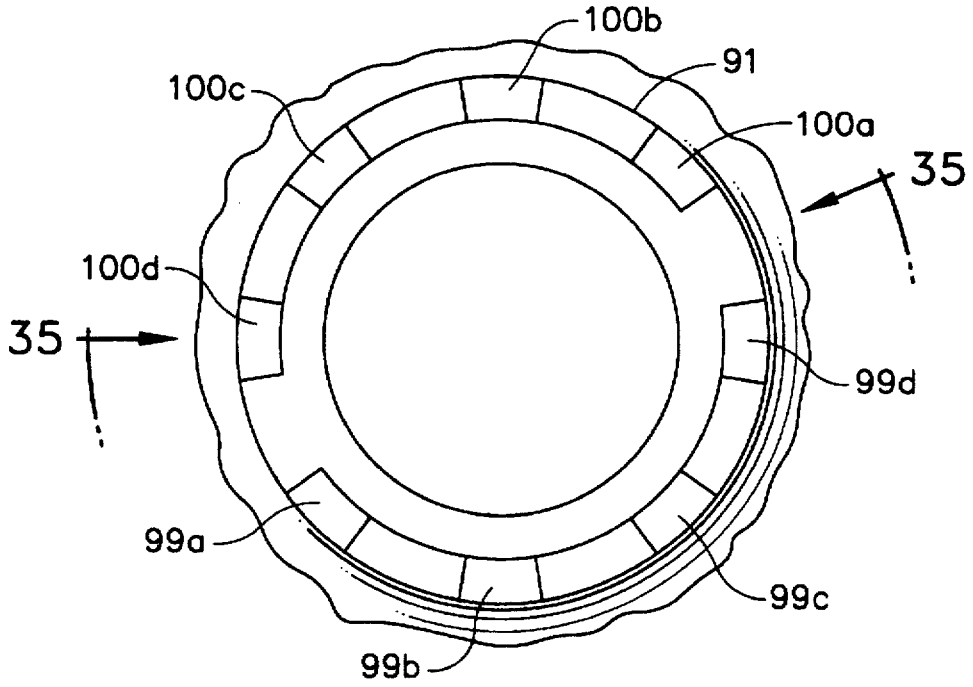
FIG. 34 is a fragmentary plan view of the movable body part spindle of FIG. 33.
Figure 35:
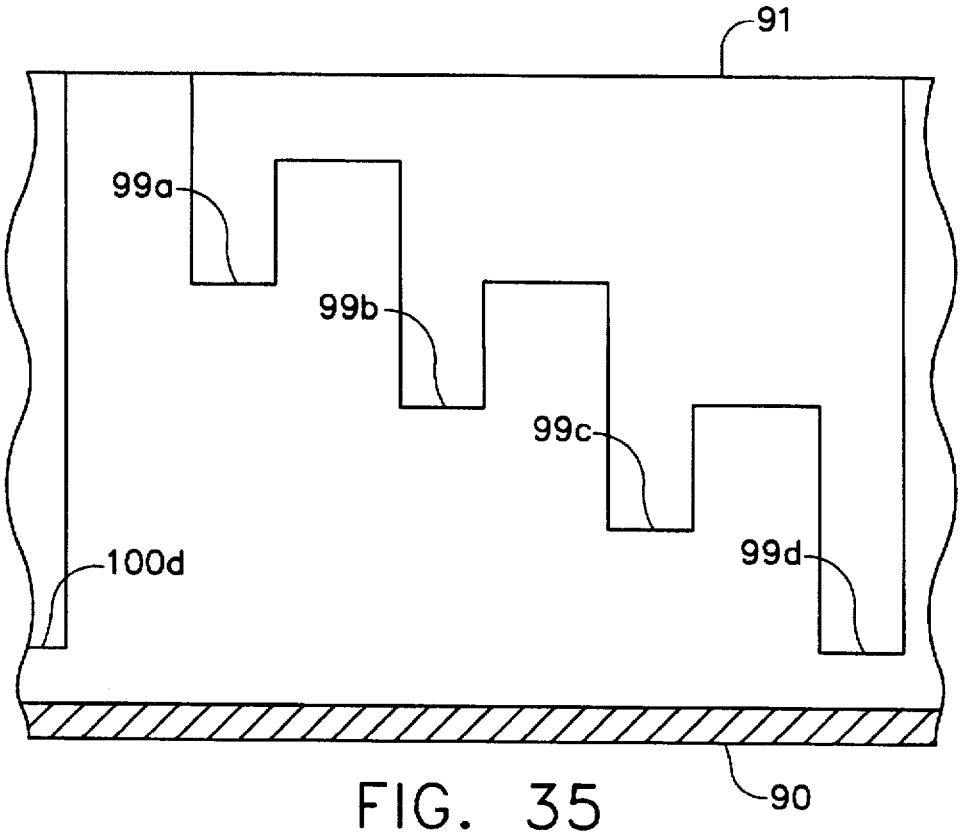
FIG. 35 is a fragmentary elevational view of the spindle 34 as viewed from line 35—35.

FIGS. 33–35 illustrate a second embodiment of adjustable support platform or surface for a coil of fasteners. FIG. 33 illustrates fragmentarily and in semi-diagrammatic manner a movable body part 2C for magazine 2 which is similar to movable body part 2B of FIGS. 12–17. In this instance, however, the magazine bottom 90 does not, itself, provide the support surface for the fastener coil. The magazine bottom 90 has an upstanding spindle 91 with an axial bore 92 extending therethrough. Near the bottom 90, the bore 92 is of increased diameter as at 92*a* forming an internal annular shoulder 93.

A substantially circular fastener coil support 94 is provided, having its own central, upstanding, hollow spindle 95. The hollow spindle 95 has an internal diameter sized to just nicely receive spindle 91. The fastener coil support 94 has, within its hollow spindle, a pair of diametrically opposed lugs 97 and 98.

Reference is now made to FIGS. 34 and 35. The spindle 91 of FIG. 33 is shown in a plan view in FIG. 34. In FIG. 35, about one-half the periphery is diagrammatically shown along line 35–35 in "unrolled" condition.

As can be ascertained from both FIGS. 34 and 35, one-half the periphery of spindle 91 is provided with four notches 99*a*–99*d* of increasing depth. In a similar fashion, the other peripheral half of spindle 91, is provided with a corresponding and identical set of notches 100*a*–100*d*. Notches 99*a*, 99*b*, 99*c* and 99*d* correspond to notches 100*a*, 100*b*, 100*c* and 100*d*, respectively, in size and depth. Returning to FIG. 33, the notches 99*a*–99*d* and 100*a*–100*d* are diagrammatically represented in the Figure, since they do not extend about the periphery of spindle 91, as they do in FIGS. 34 and 35. When the internal lugs 97 and 98 of support 94 are located in corresponding notches 99*a* and 100*a*, the support 94 will be in its uppermost position accommodating nails of the shortest shank drivable by fastener driving tool 1. When the lugs 97 and 98 are in corresponding notches 99*d* and 100*d*, the support 94 will be in its lowermost position indicated in broken lines at 94*c*, accommodating long shanked fasteners. When the support lugs 97 and 98 are located in corresponding slots 99*b* and 100*b* or corresponding slots 99*c*–100*c*, the support 94 will occupy intermediate positions indicated in broken lines at 94*a* and 94*b*, respectively.

It will be evident that in the particular embodiment illustrated, the support 94 is capable of occupying four different positions, thereby accommodating strips of nails having shanks of four different lengths. It is only necessary to lift the support 94 slightly to a new set of corresponding notches which will locate the support at the desired height.

To enable the support 94 to be lifted and rotated, and at the same time to maintain the support captive in the assembly, a headed lug 101 extends into the axial bore 92–92*a* of spindle 91. The headed lug 101 rests either on the bottom surface of the movable body part bottom 90 or the shoulder 93, or both. Attached to the lug 101 is a tension spring 102. Tension spring 102 is attached to the upper end of spindle 95, as at 103. In this way, the support 94 is captive on spindle 91 but can be raised against the action of spring 102 and rotated so that its lugs can be located in any one of the four cooperating pairs of slots.

It will be understood by one skilled in the art that when the adjustable support of FIG. 33 is used, the movable canister body part 2C can be hinged directly to the fixed canister body part, so long as the support 94 is fully exposed for loading when the movable body part 2C is in its open position. The movable body part 2C can be maintained in its closed position by the gate 12 of the tool feed mechanism 9, in the same manner described with respect to magazine movable body part 2B. The movable body part 2C may also be provided with lugs equivalent to the lugs 52 and 53 of movable body part 2B to cooperate with grooves in the magazine fixed body part such as grooves 28 and 29 of FIG. 6.

Except for shafts and springs, the parts of the canister-type magazine of the present invention may be molded of plastic. While it is preferable that the plastic be lightweight and strong, any appropriate plastic material can be used. Excellent results have been achieved, for example, when the canister-type magazine of the present invention was molded of glass reinforced nylon.

As used herein and in the claims, such words as "horizontal", "vertical", "top", "bottom", "forwardmost", "rearwardmost", and the like, are used in conjunction with the drawings for purposes of clarity. It will be appreciated that the tool 1, in use, may be held in any appropriate orientation.

Modifications may be made in the invention without departing from the spirit of it.

What is claimed:

1. A canister-type magazine for a fastener driving tool of the type having a tool body and using a coil of tandomly arranged fasteners, said magazine comprising a substantially cylindrical body having a top, side walls fastener coil supporting bottom surface and being made up of a fixed body part and a movable body part, said fixed body part having forward and rearward ends attached to said tool body, said fixed body part comprising said top and a first side wall of said magazine, said movable body part having forward and rearward ends and comprising said fastener coil supporting bottom surface and a second side wall of said magazine, said movable body part being operatively attached to said fixed body part near said rearward ends of said fixed and movable body parts, said movable body part being pivotable with respect to said fixed body part between a closed position wherein said fastener coil supporting bottom surface of said movable body part is beneath said tool body and said magazine top and an open position wherein said fastener coil supporting bottom surface of said movable body part is fully exposed and out from under said magazine top and said tool body, wherein said operative attachment of said movable body said fixed body part to said magazine is such that said movable body part is shiftable toward and away from said magazine top in a direction perpendicular to said support surface and is lockable in any one of a number of adjusted positions along said direction, whereby said magazine can accommodate fasteners of different lengths.

2. The magazine claimed in claim 1 wherein said first side wall of said fixed body part has an inside surface and has on said surface, near its forward and rearward ends, a forward and rearward series of grooves being arranged parallel to said fastener coil supporting bottom surface, said grooves of each series being arranged one above the other and evenly spaced from each other, said grooves of said forward and rearward series being equal in number and aligned, said movable body part having a pair of aligned peripheral lugs which, when said movable body part is in said closed position, engage in a corresponding pair of said grooves of said forward and rearward series whereby to prevent said movable body part from sagging when supporting a fastener coil.

3. The magazine claimed in claim 1 wherein said movable body part is spring biased to said open position.

4. The magazine claimed in claim 1 wherein said forward ends of said fixed body part and said movable body part of said magazine, when said movable body part is in said closed position, define a channel for said fasteners directing said fasteners out of said magazine.

5. The magazine claimed in claim 1 wherein said movable body part of said magazine has at least two hinge elements formed thereon near said rearward end thereof, a hinge member having hinge elements thereon adapted to cooperate with said movable body part hinge elements, a hinge pin passing through coaxial holes in all of the aforesaid hinge elements, said hinge member having a body with longitudinal edges, a hinge member support extending rearwardly of said rearward end of said fixed body part, said hinge member support comprising a panel-like structure flanked by a pair of facing channel-forming members, said hinge member body longitudinal edges being received in said channel forming elements and being slidable therein in said direction perpendicular to said support surface, means to lock said hinge member body in any one of a plurality of adjusted positions with respect to said hinge member support to lock said movable body part in any one of said adjusted positions thereof.

6. The magazine claimed in claim 1 wherein said first side wall of said fixed body part has an inside surface and has on said inside surface, near its forward and rearward ends, a forward and rearward series of grooves being arranged parallel to said fastener coil supporting bottom surface, said grooves of each series being arranged one above the other and evenly spaced from each other, said grooves of said forward and rearward series being equal in number and aligned, said movable body part having a pair of aligned peripheral lugs which, when said movable body part is in any one of said adjusted positions and is closed with respect to said fixed body part, will engage in an appropriate one of said corresponding pairs of grooves of said forward and rearward series of said fixed body part to prevent said movable body part from sagging when supporting a fastener coil.

7. The structure claimed in claim 5 wherein said body of said hinge member has a surface facing and adjacent said panel portion of said hinge member support, said surface of said hinge member and said hinge member support panel portion having corresponding transverse slots formed therein which are evenly spaced such that in each adjusted position of said hinge member with respect to said hinge member support, some of said hinge member slots and said hinge member support slots will be aligned, a cam lock comprising a body having a handle, said cam lock body is pivotally mounted on a shaft adjacent that side of said panel portion of said hinge member support opposite said hinge member and extending longitudinally of said panel portion, said cam lock body having transverse arcuate engagement members thereon equal in number to and aligned with said slots in said panel portion of said hinge member support, said cam lock being manually rotatable between an open position wherein said engagement members are outside said slots of said hinge member support panel portion and a closed position wherein said cam lock engagement members extend through said slots of said hinge member support panel portion and into any of said hinge member slots aligned therewith to lock said hinge member and said movable body part of said magazine in adjusted position with respect to said hinge member support and said fixed body part of said magazine.

8. The magazine claimed in claim 5 wherein there is a space between one of said movable body part hinge elements and the adjacent one of said hinge member hinge elements, a cylindrical resilient member, a torsion spring having a coiled body with outwardly extending arms, said resilient member being located within said coiled body of said torsion spring, said resilient member having an axial bore of a diameter slightly less than the diameter of said hinge pin, said torsion spring and said resilient member being located in said space between said hinge elements, said hinge pin passing through said axial bore of said resilient member, said hinge pin having an annular groove formed therein, said hinge pin groove being positioned adjacent said resilient member when said hinge pin is fully seated with respect to said hinge elements, said resilient member being expandable into said hinge pin groove to retain said hinge pin releasably captive in said hinge elements, said torsion spring arms being engaged with said movable body part of said magazine and said hinge member in such a way as to spring bias said movable body part to said open portion.

9. A hinge assembly for use with a fastener driving tool magazine of the canister type having first and second parts, said hinge assembly joining said part and second parts together, said hinge assembly having a hinge pin comprising an elongated body, said first and second parts being pivotable toward and away first each other about said hinge pin, said hinge assembly having members shiftable with reset to each other to shift said first and second parts with respect to each other in directions parallel to an axis through said elongated body of said hinge pin further including a latch element to first and second parts in any desired one of a plurality of positions with respect to each other along said directions, wherein said first part has at least two hinge elements formed thereon, a hinge member having elements thereon adapted to operate with said hinge elements of said first part, a hinge pin passing through coaxial holes in all of the aforesaid hinge elements, said hinge member having a body with longitudinal edges, a hinge member support on said second part, said hinge member support comprising a panel-like structure flanked by a pair of facing channel-forming members, said longitudinal edges of said hinge member body being received in said channel-forming members and being shiftable therein in a direction parallel to an axis through said hinge pin, said latch element locking said body of said hinge member in said any one of a plurality of positions with respect to said hinge member support to lock said first and second parts in said any one of a plurality to positions thereof.

10. The hinge assembly claimed in claim 9 wherein said body of said hinge member has a surface facing and adjacent to said panel-like structure of said hinge member support, said surface of said hinge member and said hinge member support panel-like structure having corresponding transverse slots formed therein which are evenly spaced such that in each position of said hinge member with respect to said hinge member support, at least some of said hinge member slots and said hinge member support slots will be aligned, said latch element comprising a body having a handle, said latch element body being pivotally mounted on a shaft adjacent a side of said panel-like structure of said hinge member support opposite said hinge member and extending longitudinally of said panel-like structure, said latch element body having transverse arcuate engagement members thereon equal in number to and aligned with said slots in said panel-like structure of said hinge member support, said latch element being rotatable between an open position wherein said engagement members are outside said slots of said hinge member support panel-like structure and a closed position wherein said engagement members extend through said slots of said hinge member support panel-like structure and into any of said hinge member slots aligned therewith to lock said hinge member and said first part in a position with respect to said hinge member support and said second part.

* * * * *